US008365691B2

(12) United States Patent
Methley

(10) Patent No.: US 8,365,691 B2
(45) Date of Patent: Feb. 5, 2013

(54) VARIABLE VALVE ACTUATING MECHANISM WITH LIFT DEACTIVATION

(75) Inventor: Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 315 days.

(21) Appl. No.: 12/864,042

(22) PCT Filed: Dec. 18, 2008

(86) PCT No.: PCT/GB2008/051198

§ 371 (c)(1),
(2), (4) Date: Jul. 22, 2010

(87) PCT Pub. No.: WO2009/092995

PCT Pub. Date: Jul. 30, 2009

(65) Prior Publication Data

US 2010/0294222 A1 Nov. 25, 2010

(30) Foreign Application Priority Data

Jan. 22, 2008 (GB) ..... 0801050.6

(51) Int. Cl.
*F01L 1/34* (2006.01)

(52) U.S. Cl. ..... 123/90.16; 123/90.39

(58) Field of Classification Search ..... 123/90.16, 123/90.15, 90.39
See application file for complete search history.

(56) References Cited

U.S. PATENT DOCUMENTS

| | | | | |
|---|---|---|---|---|
| 4,203,397 | A | 5/1980 | Soeters, Jr. | |
| 6,425,357 | B2 * | 7/2002 | Shimizu et al. | 123/90.16 |
| 7,121,241 | B1 | 10/2006 | Genise et al. | |
| 7,162,983 | B1 | 1/2007 | Raghavan et al. | |
| 2007/0266973 | A1 * | 11/2007 | Lancefield et al. | 123/90.16 |

FOREIGN PATENT DOCUMENTS

| | | |
|---|---|---|
| DE | 19701201 | 7/1998 |
| DE | 19802738 | 7/1999 |
| DE | 10316189 | 10/2004 |
| DE | 10326238 | 2/2005 |
| EP | 0671550 | 9/1995 |
| EP | 1426596 | 6/2004 |
| EP | 1857642 | 11/2007 |
| GB | 2378729 | 2/2003 |
| GB | 2438628 | 12/2007 |
| WO | WO03016684 | 2/2003 |
| WO | WO2004067922 | 8/2004 |
| WO | WO2005093224 | 10/2005 |
| WO | WO2006007817 | 1/2006 |
| WO | WO2008139221 | 11/2008 |

* cited by examiner

*Primary Examiner* — Zelalem Eshete
(74) *Attorney, Agent, or Firm* — Shalom Wertsberger; Saltamar Innovations

(57) ABSTRACT

An internal combustion engine is described having a valve mechanism that comprises two cams 120,122 mounted coaxially and a summation lever 124 having cam followers 126, 127 in contact with both cams so as to move in proportion to the instantaneous sum of the lifts of the respective cams. A control spring 128 is provided to maintain contact between one cam profile and its respective follower(s), and a valve actuating rocker 114 having a stationary pivot and rotatably connected to the summation lever serves to open the engine valve 110 in dependence upon the movement of the summation lever, so as to enable the valve timing, valve lift and valve event duration to be adjusted by varying the phases of the two cams. In the invention, the summation lever is constructed in two parts 124*a*, 124*b* that can be selectively locked and unlocked to allow the valve lift to be deactivated and the motion of both parts is controlled by the control spring 128 when the two parts of the summation lever are unlocked from one another.

15 Claims, 12 Drawing Sheets

VARIABLE VALVE ACTUATING MECHANISM WITH LIFT DEACTIVATION

FIELD OF THE INVENTION

The invention relates to an internal combustion engine having a valve actuating mechanism that comprises two cams mounted coaxially, a summation lever having at least one cam follower in contact with each respective cam and movable in proportion to the instantaneous sum of the lifts of the two cams, a control spring acting to maintain one cam in contact with each follower associated therewith, and a valve actuating rocker serving to open an engine valve in dependence upon the movement of the summation lever, the timing, lift and duration of each valve event being adjustable by varying the phases of the two cams.

BACKGROUND OF THE INVENTION

An internal combustion engine as set out above is described in the Applicants' earlier GB Patent Application No. 0708967.5. In the accompanying drawings, FIG. 1*a* is a perspective view of a valve actuating mechanism as described in the latter patent application and FIG. 1*b* is a section through the same mechanism. A poppet valve 10 is urged towards its closed position against its valve seat in the engine cylinder head by a valve spring 12. A downwards force to open the valve 10 is applied by an actuating rocker 14 of which the opposite end is pivoted on an adjustable articulated link 16. Valve actuation is effected by a camshaft driven in synchronism with the engine crankshaft which carries two cams 20 and 22 that can be phase shifted in relation to one another. The cam 20 is formed from two identical parts that straddle the other cam 22. A summation lever 24, which is pivotably carried by the actuating rocker 14 has roller followers 26, 27 at its opposite ends one of which is maintained in contact with a respective one of the two cams 20 and 22 by a control spring 28. The control spring 28 is required in a cam summation system of this type in order to control the motion of the summation lever 24 and to maintain contact between the actuating rocker 14 and the valve tip whilst the valve is closed. It can be seen from FIG. 1*b* that the control spring 28 acts in a downward direction to force the adjacent cam follower 26 away from its cam lobe 22, and this forces the two followers 27 on the opposite side of the summation lever into contact with their respective cam lobes 20.

The present invention seeks to provide an improvement of the valve actuating mechanism described above which additionally enables the valve 10 to be deactivated.

It has been previously proposed in WO03/016684 to provide valve deactivation in a valve train employing a summation lever by forming the summation lever in two parts that may be selectively locked to one another. FIGS. 2*a*, 2*b* and 2*c* of the accompanying drawings correspond respectively to FIGS. 11, 12 and 13 of WO03/016684. The two parts 24*a* and 24*b* of the summation lever are pivotable relative to one another about a pivot pin 30 and can be locked to one another by a locking pin 32. In the locked position shown in FIGS. 2*a* and 2*c* the summation lever moves as one piece and opens the valve 10 under the action of the two cams 20 and 22. However, when the locking pin 32 is released, as shown in FIG. 2*b*, the two parts 24*a* and 24*b* are merely articulated relative to another by the action of the two cams 20 and 22 and the valve remains closed.

It is well accepted that a valve deactivation system requires a lost motion spring to control the position of the valve train system and maintain contact between each cam lobe and its follower during the cam lift event when it is being operated with the valve deactivated. However, WO03/016684 is silent on how such a spring is incorporated in the valve deactivation system.

SUMMARY OF THE INVENTION

According to the present invention, there is provided an internal combustion engine having a valve mechanism that comprises two cams mounted coaxially, a summation lever having cam followers in contact with both cams, the summation lever being moveable in proportion to the instantaneous sum of the lifts of the respective cams, a control spring to maintain contact between one cam profile and its respective follower(s), and a valve actuator serving to open the engine valve in dependence upon the movement of the summation lever, so as to enable the valve timing, valve lift and valve event duration to be adjusted by varying the phases of the two cams, wherein the summation lever is constructed in two parts that can be selectively locked and unlocked to allow the valve lift to be deactivated and the motion of both parts is controlled by the control spring when the two parts of the summation lever are unlocked from one another.

The invention employs a two part summation lever design, which allows the followers for the two different cam profiles to move independently from one another. It also provides a latch mechanism for locking the two parts together. The key feature of the design is that it allows the control spring to act as a lost motion spring whilst the valve lift is deactivated, as well as controlling the movement of the summation lever to ensure that its cam follower(s) maintain contact with one of the cam profiles at all times. By combining the functions of the lost-motion spring required by a deactivation system and the control spring required by a cam summation system, the invention enables valve deactivation to be achieved with a minimum of additional complexity.

Incorporating a valve deactivation system into the summation lever is advantageous in that it allows the mass of the moving components to be minimised whilst the valve is deactivated. The disadvantage of using the summation lever is that it is difficult to find space for a sufficiently strong lost motion spring, and if such a spring were to be integrated with the actuating rocker, it would significantly add to the valve train mass during normal operation when the valve lift is activated.

BRIEF DESCRIPTION OF THE DRAWINGS

The invention will now be described further, by way of example, with reference to the accompanying drawings, in which:—

DETAILED DESCRIPTION OF THE PREFERRED EMBODIMENTS

Figure 1A:
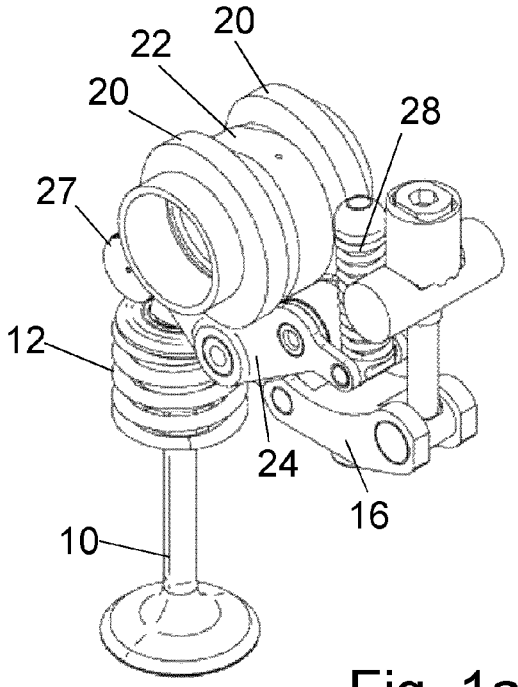
FIGS. 1*a* and 1*b* show a known cam summation system as described above.

To avoid unnecessary repetition, components serving the same function will be given similar reference numerals throughout the description of the different illustrated embodiments, but components of this first embodiment will be in the 100's series, those of the second embodiment in the 200's series and so on.

Figure 1B:
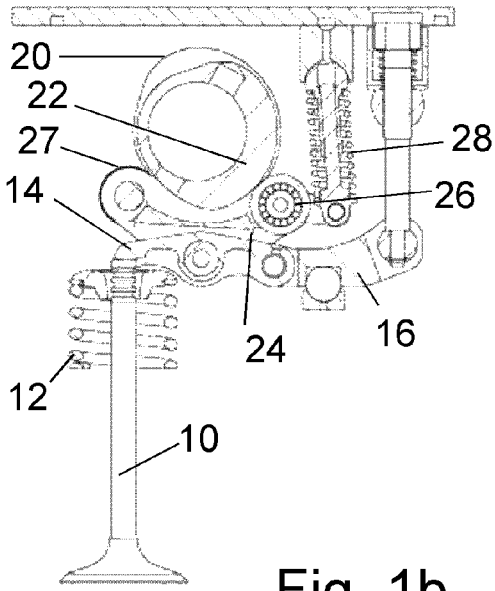
Figure 2A:
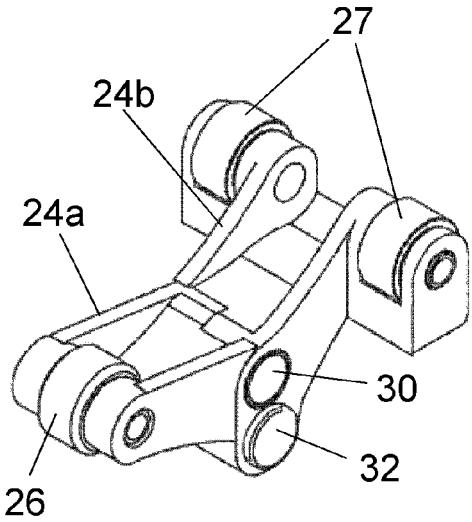
FIGS. 2*a*, 2*b* and 2*c* show a known two part summation lever as described above.
Figure 2B:
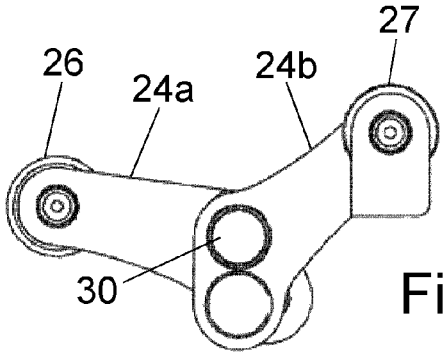
Figure 2C:
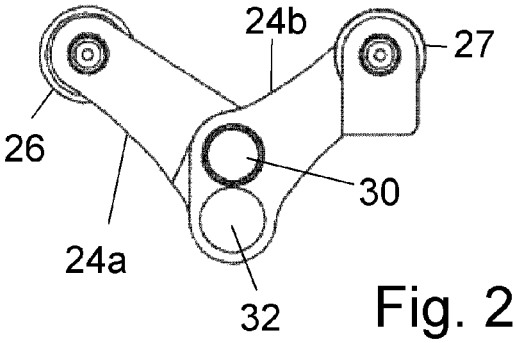
Figure 3A:
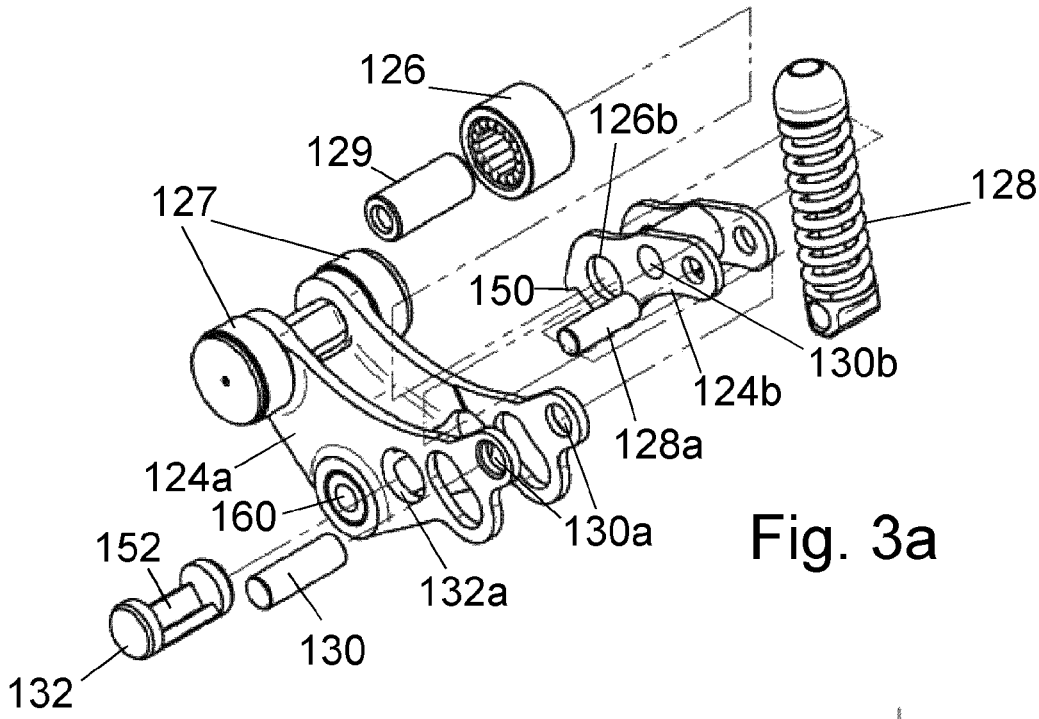
FIG. 3*a* is an exploded view of the summation lever of a first embodiment of the invention.
Figure 3B:
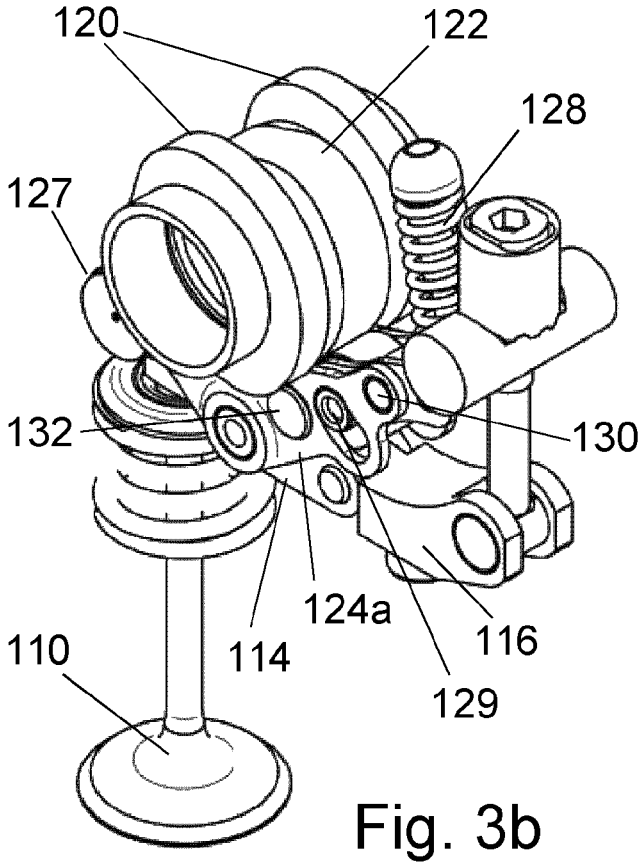
FIG. 3*b* is a perspective assembled view similar to FIG. 1*a* of the first embodiment of the invention.
Figure 3C:
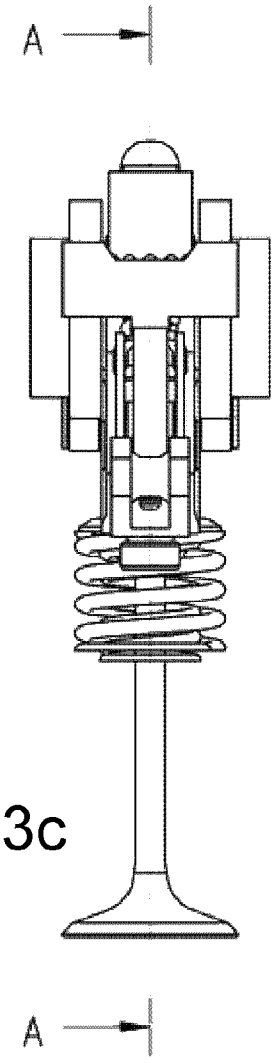
FIG. 3*c* is an end view of the first embodiment.
Figure 4A:
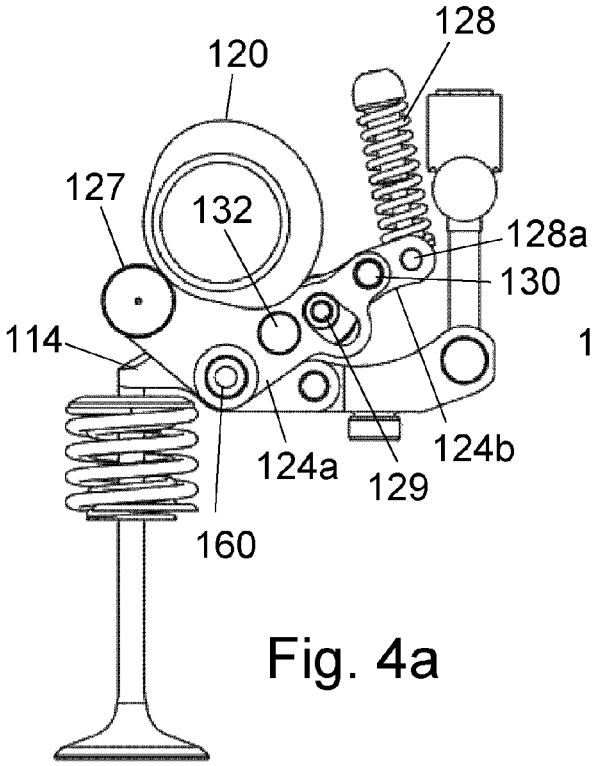
FIG. 4*a* is a side view of the first embodiment with the valve closed.
Figure 4B:
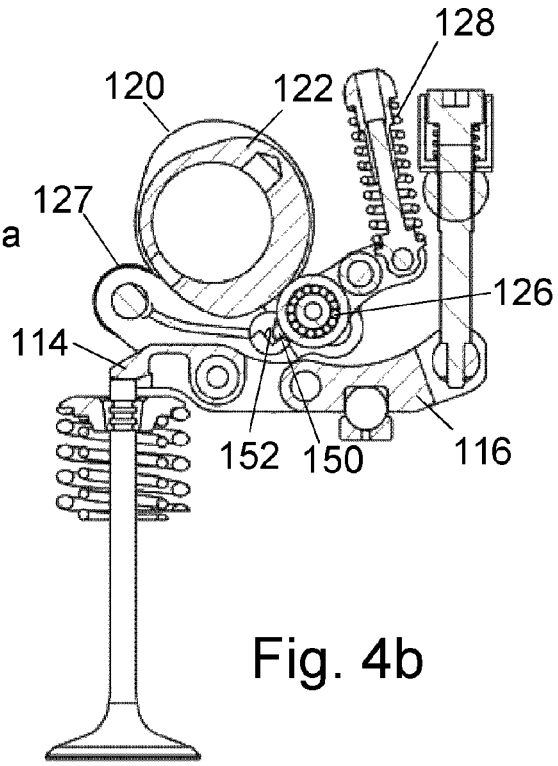
FIG. 4*b* is a section through the first embodiment (taken on the line A-A in FIG. 3*c*) with valve closed.
Figure 4C:
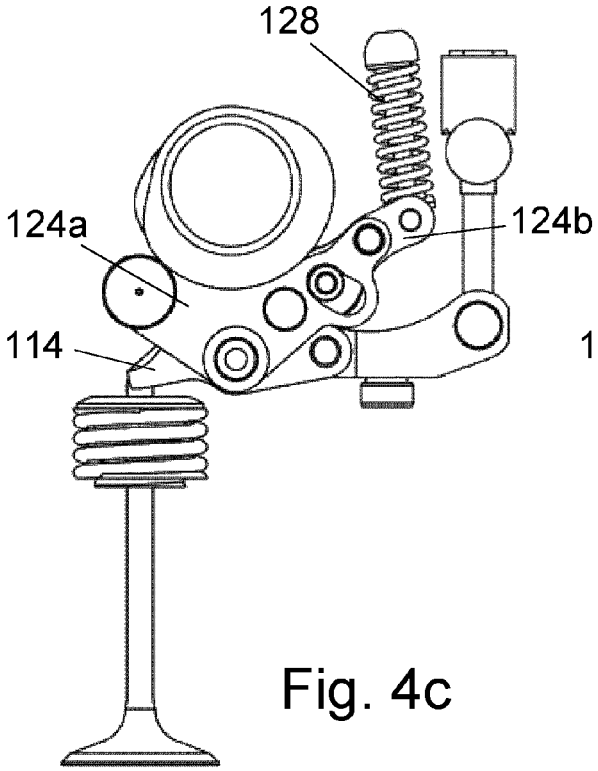
FIG. 4*c* is a side view of the first embodiment with the valve open.
Figure 4D:
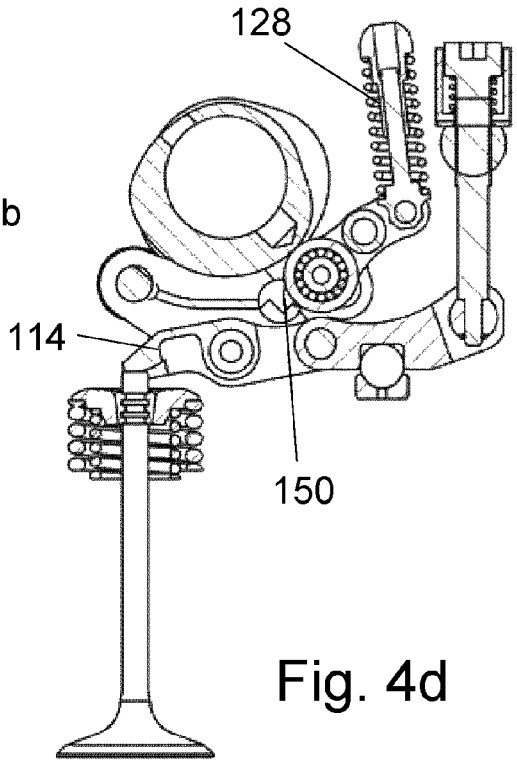
FIG. 4*d* is a section through the first embodiment (taken on the line A-A in FIG. 3*c*) with valve open.

FIGS. 3, 4 and 5 show a first embodiment of the invention which demonstrates how the invention may be applied to the valve train of FIG. 1. The summation lever is constructed in two parts 124*a* and 124*b*, that can move relative to one another. The first part 124*a* is supported by the valve actuating rocker 114 by means of a pivot 160 and carries a pair of cam followers 127 that contact the cam profiles 120. The second part 124*b* of the summation lever is connected to the first 124*a* by a pivot pin 130 received in holes 130*a* in the first part 124*a* and a hole 130*b* in the second part. The second part 124*b* carries a single cam follower roller 126, which is rotatable about an axle pin 129 and contacts the second cam profile 122. The second part 124*b* of the summation lever is also connected by a pin 128*a* received in holes in the second part 124*b* to the control spring 128 which controls the motion of the summation lever while the valve is closed.

The summation lever assembly also contains a latch mechanism for selectively preventing relative movement between the two parts of the summation lever. The latch mechanism is composed of a nose 150 on the second part 124*b* of the summation lever and a recess 152 in a latch pin 132 mounted in holes 132*a* in the first part 124*a* of the summation lever. By rotating the latch pin 132 to engage or disengage it from the nose 150, the two parts 124*a* and 124*b* of the summation lever can either be locked together or allowed to move independently.

When the latch mechanism is engaged and the two parts of the summation lever are unable to move relative to each other, the valve lift will occur in the normal manner, as shown in the views of FIGS. 4*a* to 4*d*.

Figure 5A:
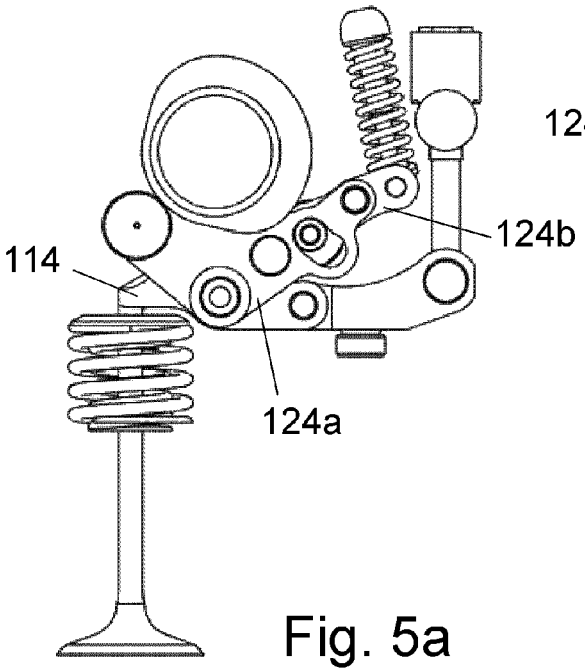
FIGS. 5*a* and 5*b* are a side view and a section of the first embodiment with the cam off lift and the valve deactivated.
Figure 5B:
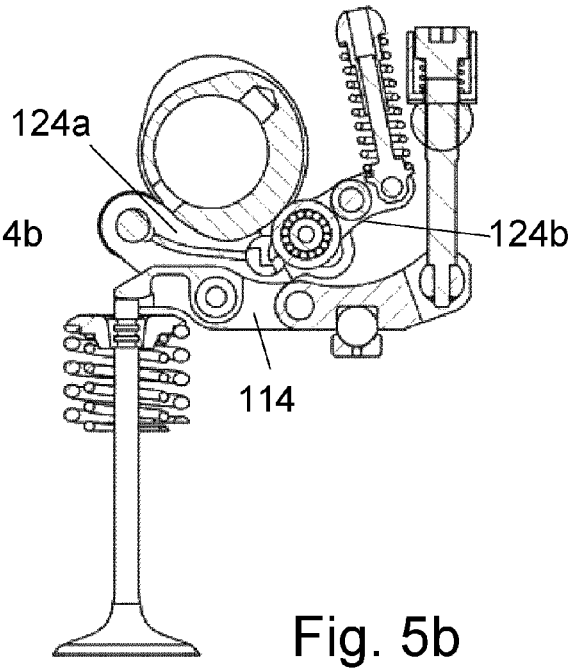
Figure 5C:
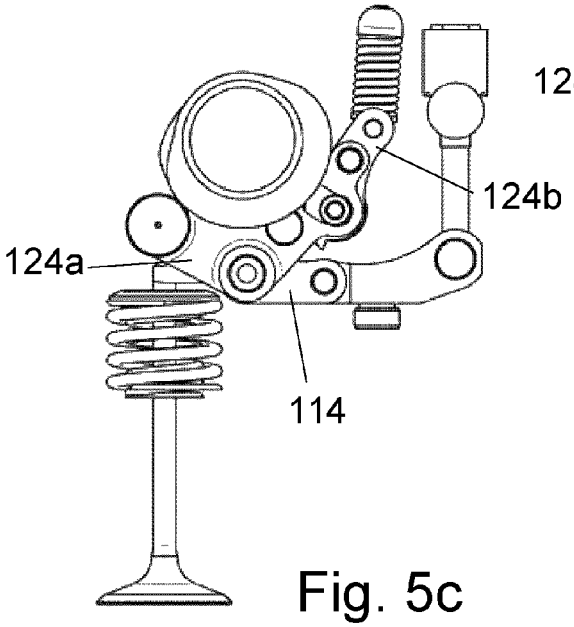
FIGS. 5*c* and 5*d* are a side view and a section of the first embodiment with the cam on lift and the valve deactivated.
Figure 5D:
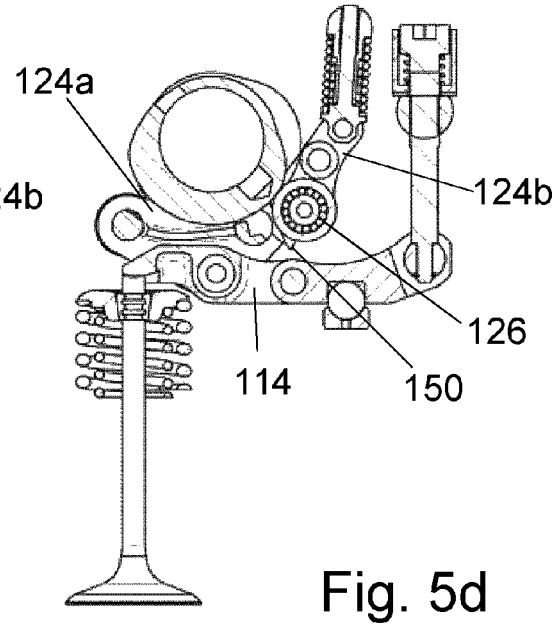

When the latch pin 132 is rotated, the two parts 124*a* and 124*b* of the summation lever are able to move relative to each other so that, when both the cams 120 and 122 are on lift, the single cam follower 126 moves independently to the pair of followers 127 causing the control spring 128 to compress instead of the valve spring, the valve 110 therefore remaining closed. The action of the control spring 128 ensures that both sets of cam followers remain in contact with their respective profiles 120, 122 throughout the lift event—thus performing the function of a lost motion spring. The operation of the system with the latch mechanism disengaged is illustrated in FIGS. 5*a* to 5*d*. The important point to notice in FIGS. 5*b* and 5*d* is that the nose 150 of the second part 124*b* of the summation lever has been allowed to move past the latch pin 132 by rotating the latter.

All of the remaining embodiments of the invention now to be described share the same fundamental principle of operation of using a two-part summation lever and utilising the summation lever control spring to act as a lost-motion spring whilst the valve lift is deactivated. It can be appreciated however that there are a wide variety of possible methods for selectively connecting and disconnecting the two parts of the summation lever.

As described above, the embodiment of FIGS. 3 to 5 uses a rotating latch pin 132 but no means have been shown for rotating the latch pin 132 to switch between valve activation modes. It is important that any changeover between operating modes should take place only while the valve is closed.

Figure 6B:
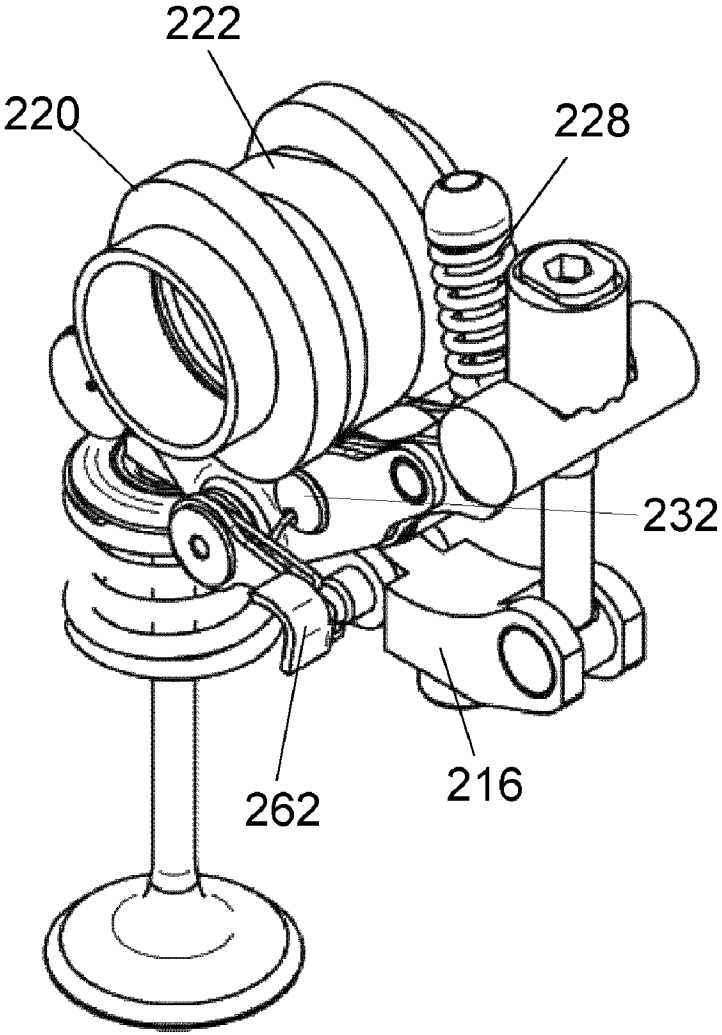
FIGS. 6*a* and 6*b* are views similar to FIGS. 3*a* and 3*b* showing an embodiment operating in the same way as the first embodiment but fitted with a lever for operating the latch mechanism.
Figure 6A:
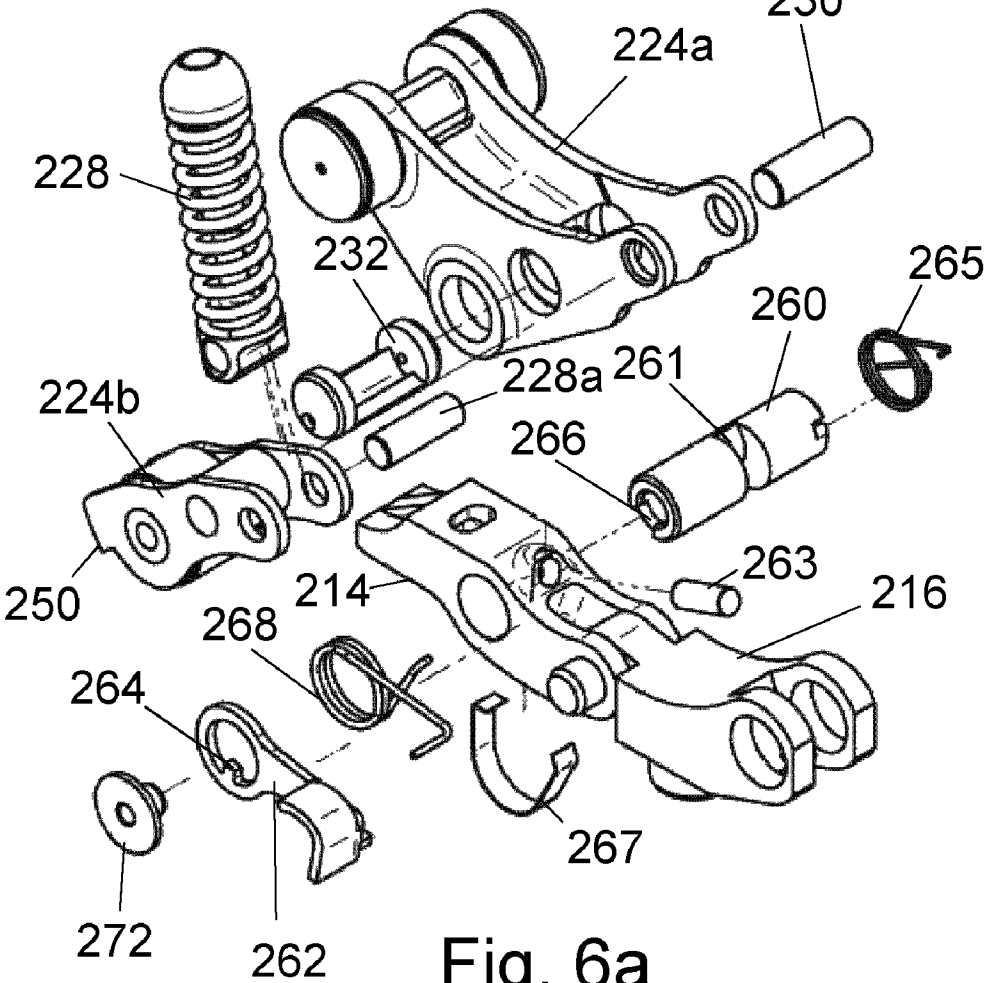

A suitable operating mechanism for rotating the latch pin of the embodiment shown in FIGS. 3 to 5 is shown in FIGS. 6 to 8. The previously described components have all been allocated the same reference numerals, but in the 200 series, and only the operating mechanism used to rotate the latch pin 232 need now be described.

Figure 8A:
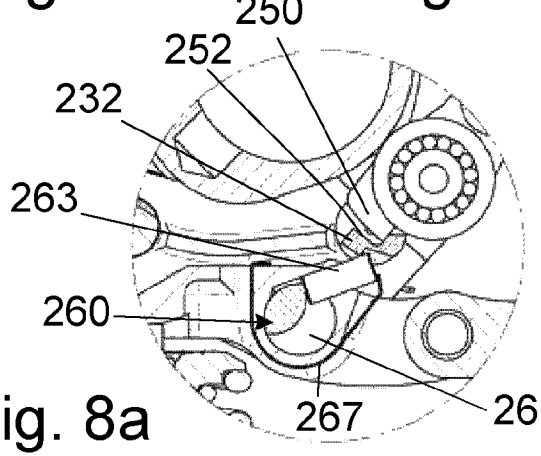
FIGS. 8*a* and 8*b* are details of FIGS. 7*c* and 7*d* drawn to an enlarged scale.
Figure 8B:
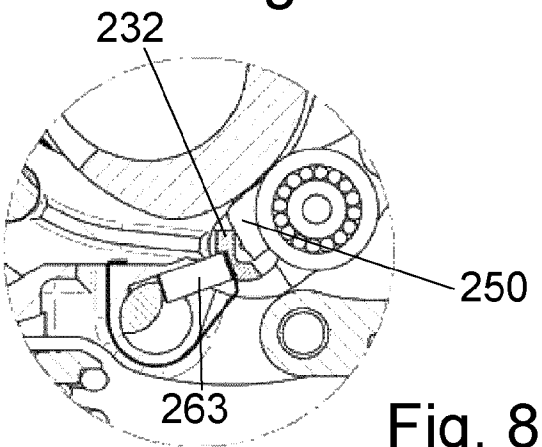

The latch operating mechanism comprises a deactivation lever 262 that is used to rotate the pivot 260 connecting the first part 224*a* of the summation lever to the valve actuating rocker 214. As best seen from the sectional views of FIGS. 8*a* and 8*b*, the pivot pin 260 has a recess 261 defining an eccentric that is engaged by a small rod 263 guided for sliding movement in the actuating rocker 214 and urged into the recess 261 by means a U-shaped spring clip 267. The opposite end of the rod 263 engages a shoulder on the opposite side of the latch pin 232 from the recess 252. If the pivot pin 260 is rotated counter-clockwise as viewed in FIG. 8*a*, the rod 263 is retracted away from the latch pin 232. The latch pin 232 is biased by the spring 268 counter-clockwise as viewed causing the nose 250 to engage in the recess 252 thereby locking the two parts of the summation lever for movement with one another. If however the pivot pin 260 is rotated clockwise by the deactivation lever 262 into the position shown in FIGS. 8*a* and 8*b*, then when the summation lever 224 attempts to rotate clockwise about the pivot pin 260, as occurs between valve events, the rod 263 engages the shoulder on the latch pin 232 causing it to rotate clockwise, as shown by FIGS. 8*a* and 8*b*. This allows the nose 250 of the second part 224*b* of the summation lever to move past the latch pin 232 and articulates the summation lever so as to prevent the valve from opening.

The spring 268 used to bias the latch pin 232 is also used to bias the deactivation lever 262. The deactivation lever 262 is retained on the end of the pivot pin 260 by a fastener 272 and is coupled for rotation with it by a spring biased lost motion coupling consisting of a narrow key 264 on the deactivation lever 262 engaged in a wider recess 266 in the pivot pin 260, the biasing spring of the pivot pin 260 being designated 265 in FIG. 6*a*.

When the valve lift is activated, the surface of a curved pad on the deactivation lever 262 is concentric with the pivot axis of the actuating rocker 214 and hence the surface maintains the same position throughout the valve lift cycle. The spring 268 acts on the lever 262 such that it will return to this position in the absence of any control input.

Figure 7A:
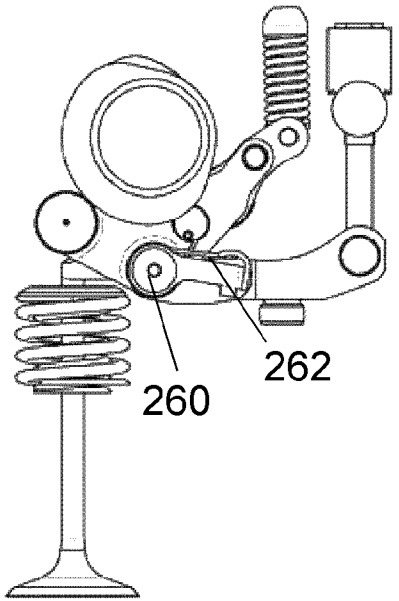
FIGS. 7*a* to 7*d* are side views and sections showing the second embodiment of the invention under different conditions.
Figure 7B:
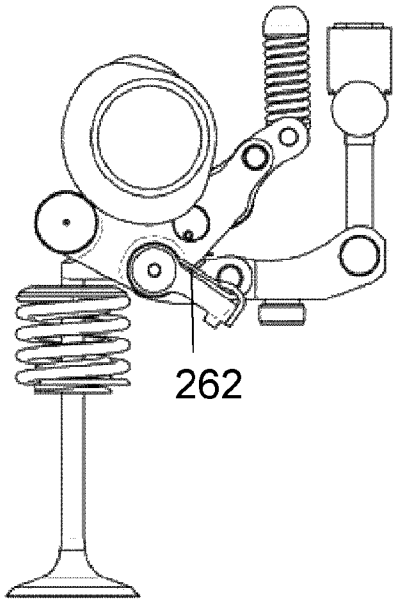
Figure 7C:
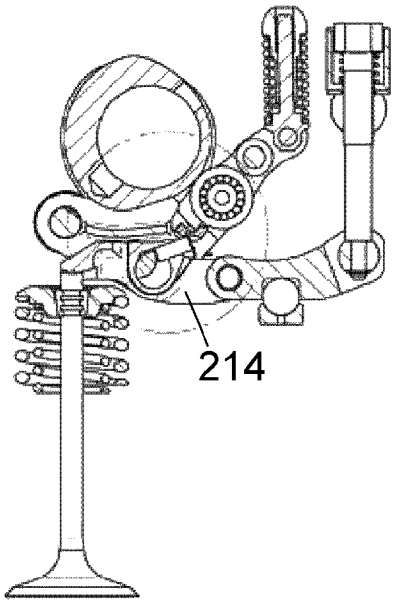
Figure 7D:
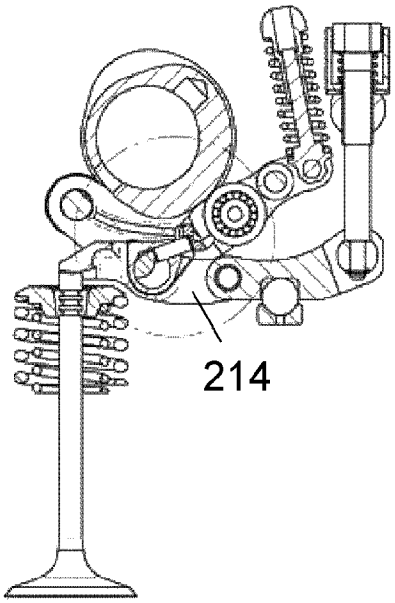

In order to deactivate the valve lift, the lever 262 may be depressed by a solenoid actuator, or by a hydraulic or mechanical actuator to the position shown in the FIG. 7*b*. This will not immediately move the pivot pin 260 but will move the key 264 to a new position. The key acts as a stop limiting the rotation of the pivot pin 260 by the spring 265. When the cams reach a suitable position for valve deactivation to take place, the pivot pin 260 will be rotated to its new position by the spring 265.

The position of the lever pad will again be constant throughout the camshaft cycle because the valve lift is deactivated and the valve actuator does not rotate about its pivot.

The embodiment of FIGS. 6 to 8 thus uses the motion of the summation lever in between valve events to ensure that the transition between valve activation and deactivation will always occur just after the valve has closed, regardless of when the motion of the deactivation lever takes place.

Figure 9B:
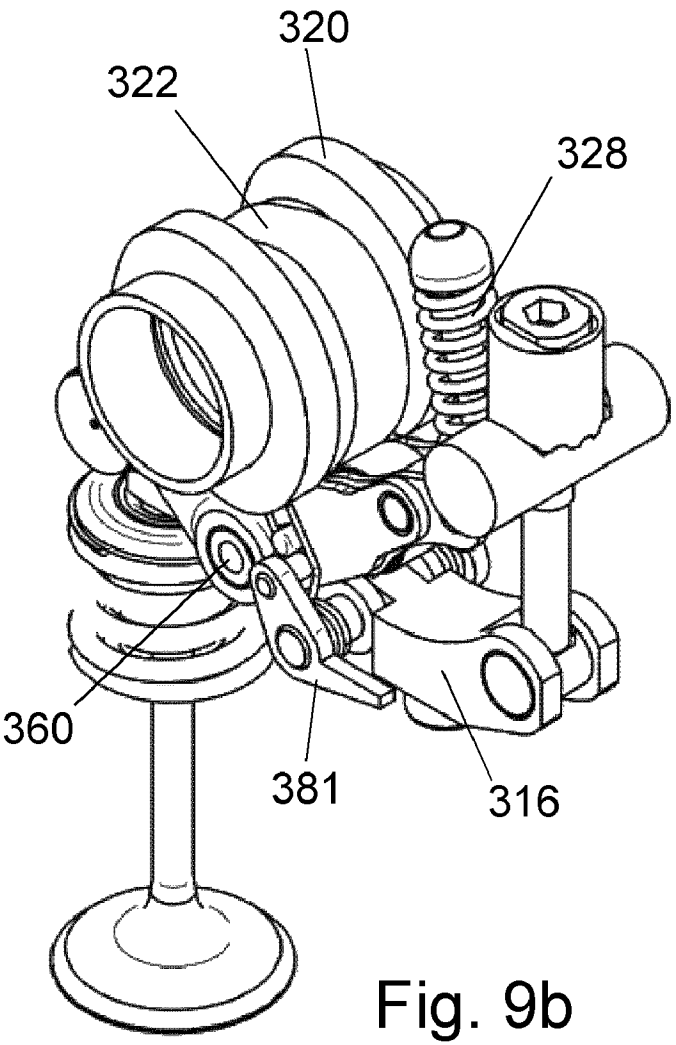
FIGS. 9*a* and 9*b* show exploded and assembled perspective view of a third embodiment of the invention.

It can be appreciated that a number of different methods exist for selectively disconnecting the two parts of the summation lever. FIGS. 9 and 10 show an alternative embodiment which, in place of a rotating latch pin, uses a sliding latch pin 383 engageable in a pair of notches 385 in the second part 324*b* of the summation lever.

Figure 9A:
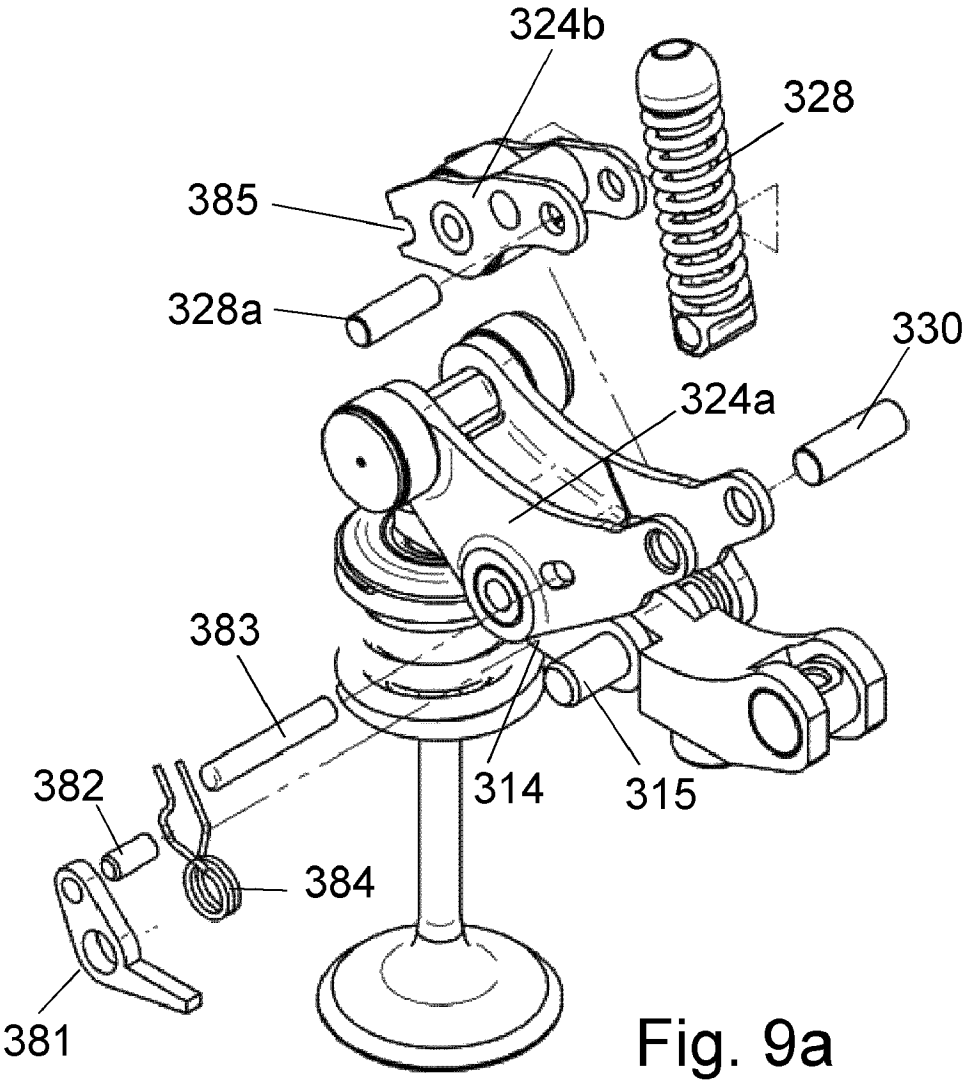
Figure 10C:
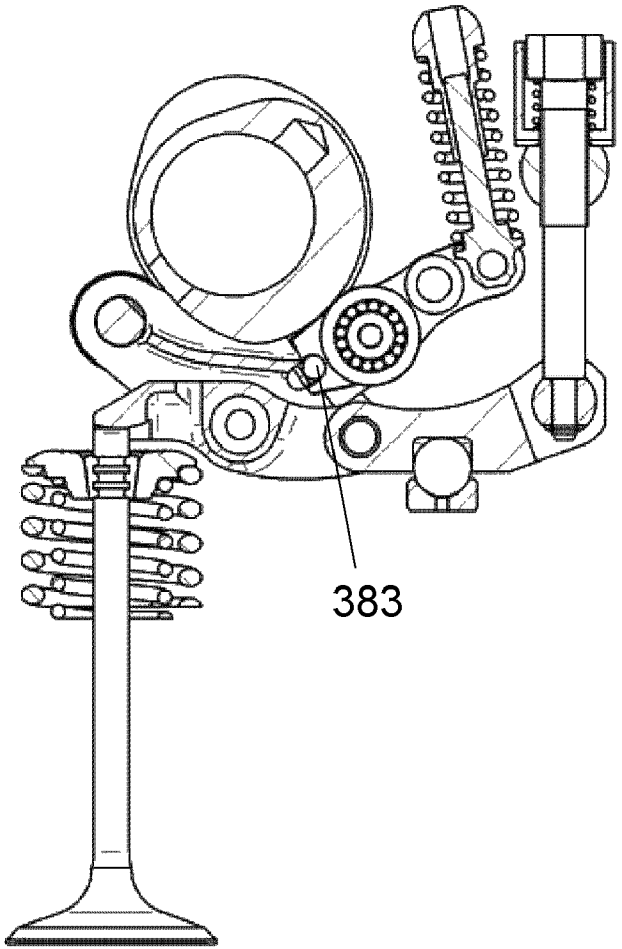
FIGS. 10*a*, 10*b* and 10*c* are an end view, a side view and a section explaining the latch mechanism employed by the third embodiment of the invention.
Figure 10B:
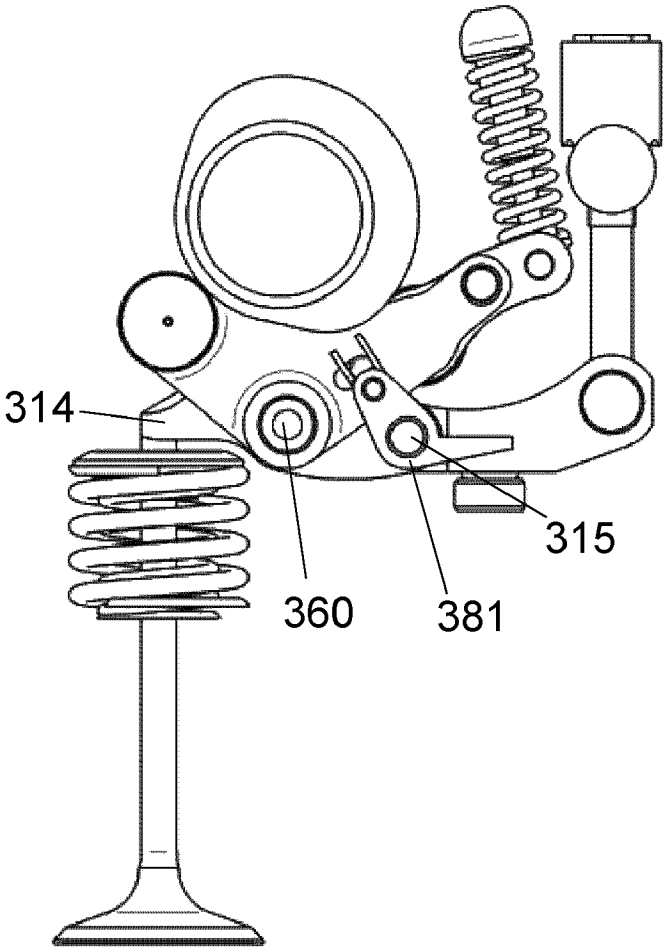
Figure 10A:
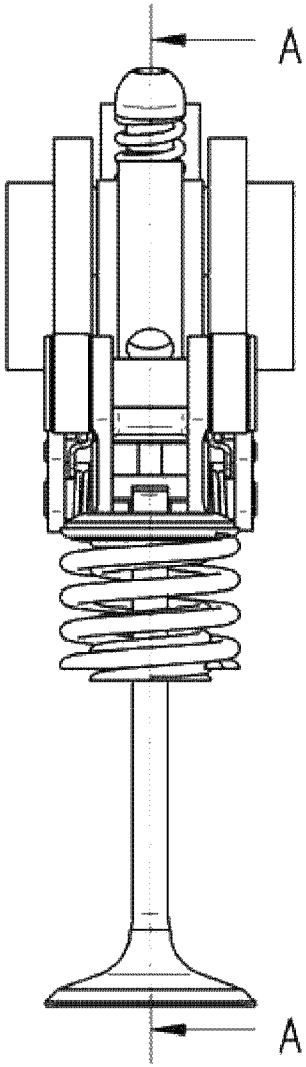

As with the previous embodiment, the system is mechanically operated by moving one of two deactivation levers 381 (only one is shown in FIG. 9*a*) pivotable about the pivot pin 315 of the actuating rocker 314. Each deactivation lever 381 has a projecting spigot 382 that engages between two arms of a torque spring 384 that is itself also free to rotate about the pivot pin 315. The ends of the latch pin 383 are straddled by the free ends of the arms of the torque springs 384. The springs 384 act as biased lost motion mechanisms connecting the deactivation levers 381 to the ends of the latch pin 383. The levers 381 tension the springs 384 and these in turn act to move the latch pin 383 at the first occasion when it is in line with the notches 385 and free to be moved by the force of the springs 384. In FIGS. 10*b* and 10*c* the latch pin 383 is shown in the engaged position from which it can be released to deactivate the associated valve by rotating the levers 381 counter clockwise.

The embodiment of FIG. 11 uses a similar latching pin 483 to the third embodiment described above, but the deactivation lever 481 forms part of an interlock mechanism such that it can only move at one point in the valve lift cycle. In this case, forked members 487 straddling the ends of the pin 483 are secured for rotation with the deactivation levers 481. The pivot shaft 460 connecting the valve actuator 414 to the summation lever 424*a* is fixed for rotation with the summation lever 424*a* and has a profiled cut-out 491 in one end that engages with an interlock pin 489 on the deactivating lever 481. FIG. 11*a* shows the interlock pin positioned outside the cut-out 491 in the pivot shaft such that the valve lift is activated. FIG. 11*d* on the other hand shows the interlock pin 489 engaged in the cut-out 491 in the pivot shaft 460 such that the valve lift is deactivated.

Figure 11D:
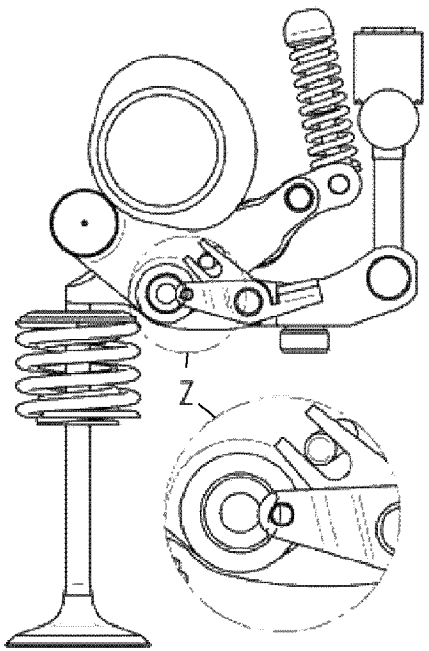
FIGS. 11*a* to 11*d* are views of a fourth embodiment of the invention using a latch mechanism similar to that of the third embodiment but a different operating mechanism for the latch pin.
Figure 11C:
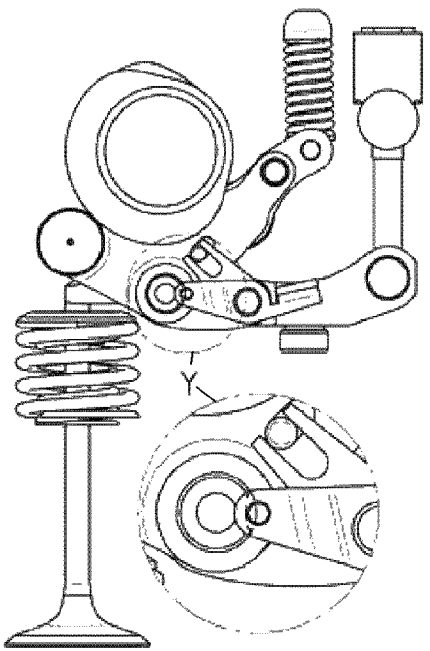
Figure 11B:
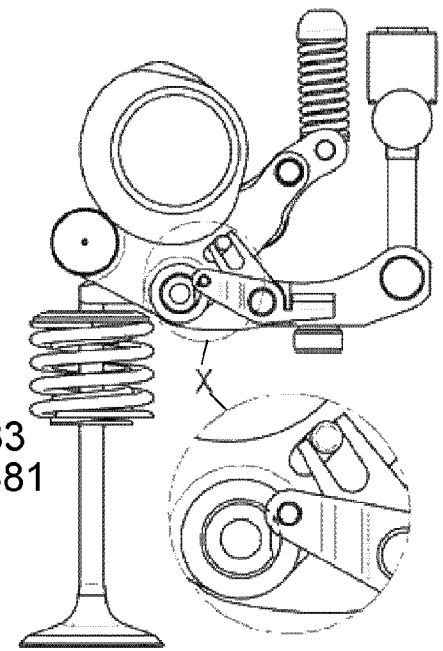
Figure 11A:
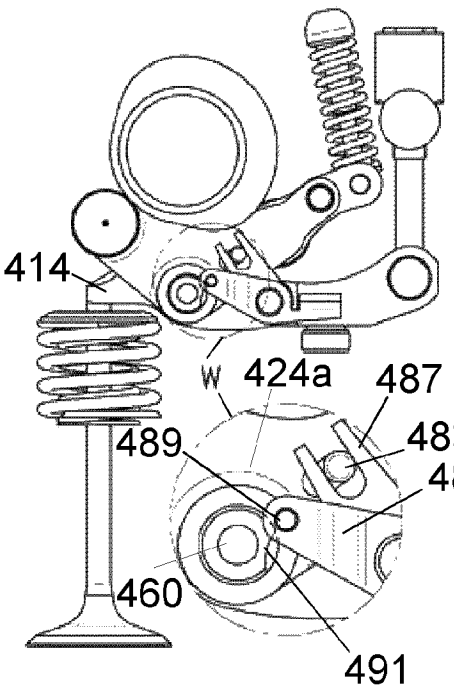
Figure 12B:
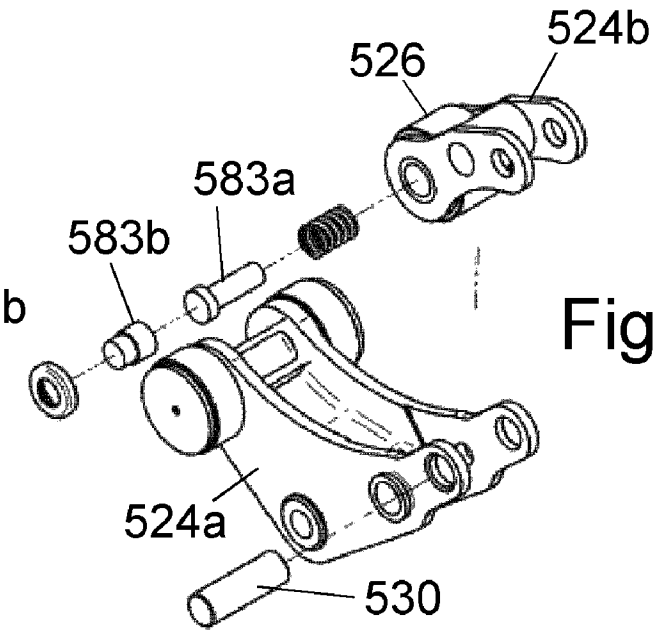
FIGS. 12*a* to 12*e* are different views of a fifth embodiment of the invention in which the latch mechanism for selectively locking the two parts of the summation lever to one another is built into the axle of the single roller follower.
Figure 12A:
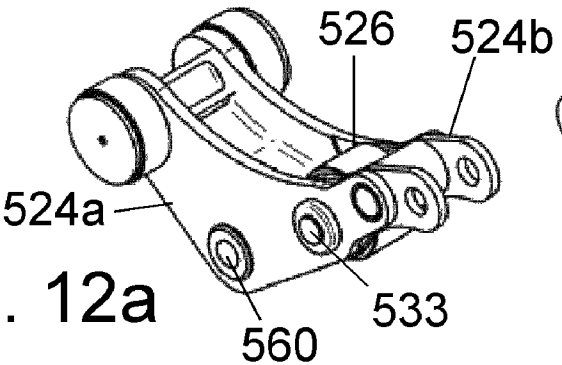
Figure 12C:
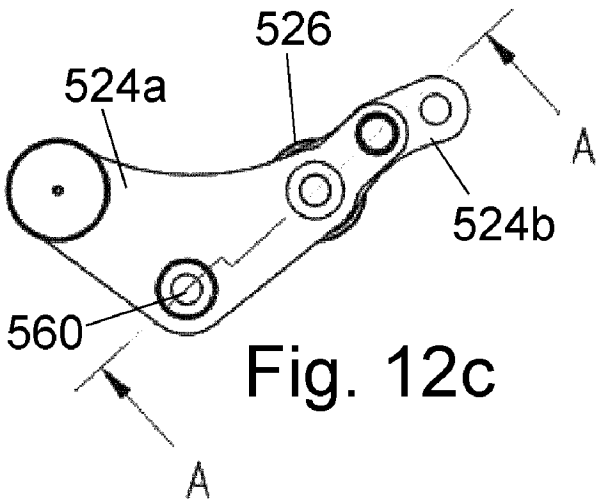
Figure 12D:
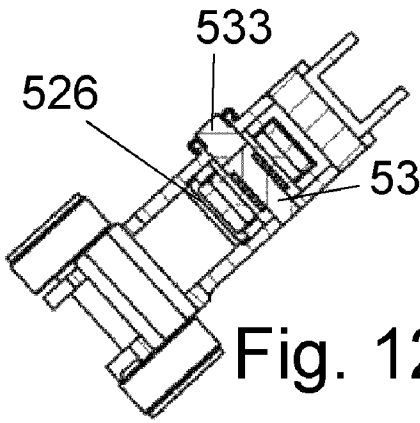
Figure 12E:
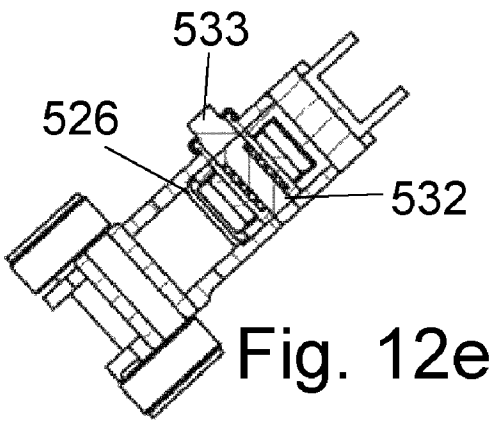

The profile of the cut-out 491 in the pivot shaft 460 prevents the interlock pin 489 from moving freely between these two positions, and it may only do so when the valve has just closed and the summation lever 424*a* is rotated to its furthest anti-clockwise position as shown in FIGS. 11*b* and 11*c*. Once the summation lever moves away from this position, the deactivation lever is locked in position until after the next valve lift event.

In addition to the deactivation capability, it would be possible to use the two-part summation lever design to adjust the clearance in the system by a small amount. For example, the latching pins 383 and 483 could be a graded component and this would allow the activated position of the second parts 324*b* and 424*b* to be adjusted relative to the main parts 324*a* and 424*a* of the summation lever.

There are further alternative latch designs that may be considered, one example being shown in FIG. 12. In this embodiment, the single roller follower 526 has a hollow axle in which there is received a spring biased latch pin 532. An actuator 533 in the form of a push button is mounted on the first part 524*a* of the summation lever and is used to push in the locking pin 532. In the position shown in the section of FIG. 12*d*, with the button 533 depressed, the latching mechanism locks the two parts of the summation lever to one another through the engagement of the locking pin 532 in a hole in one of the cheeks of the first part 524*a* of the summation lever and through engagement of the deactivation button 533 in the second part 524*b* of the summation lever. In FIG. 12*e* the latch is released and the valve is deactivated because the button 533 is retracted and the locking pin 532 does not project beyond the axle of the roller follower 526.

Figures 13A, 13B, 13C, 13D:
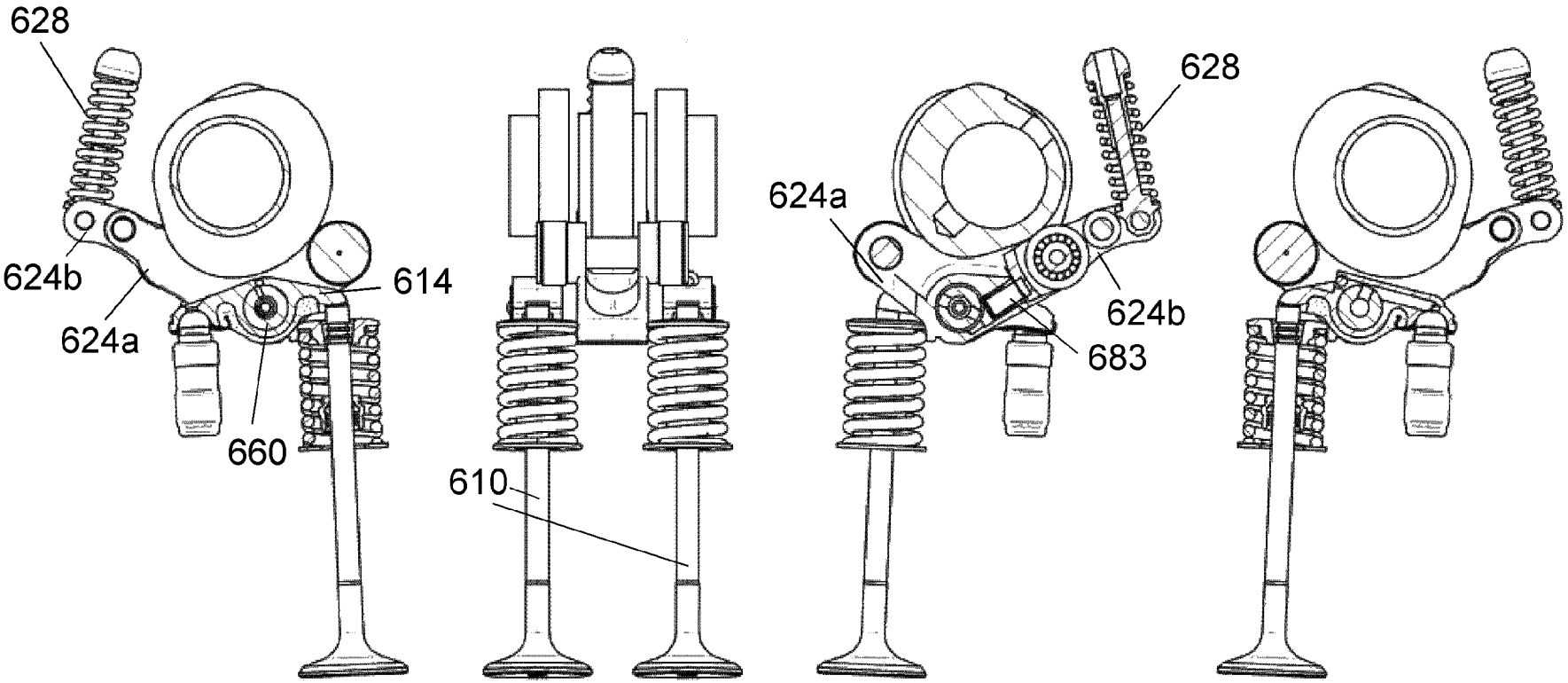
FIGS. 13*a* to 13*d* are side and end views in different positions of an embodiment having a hydraulically actuated latch mechanism.
Figure 14C:
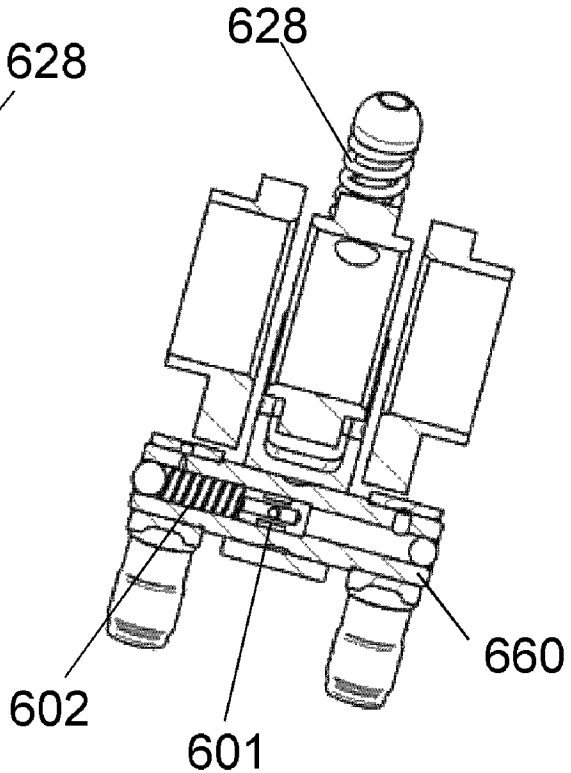
FIG. 14*c* is a section on the line D-D in FIG. 14*b*.
Figure 14B:
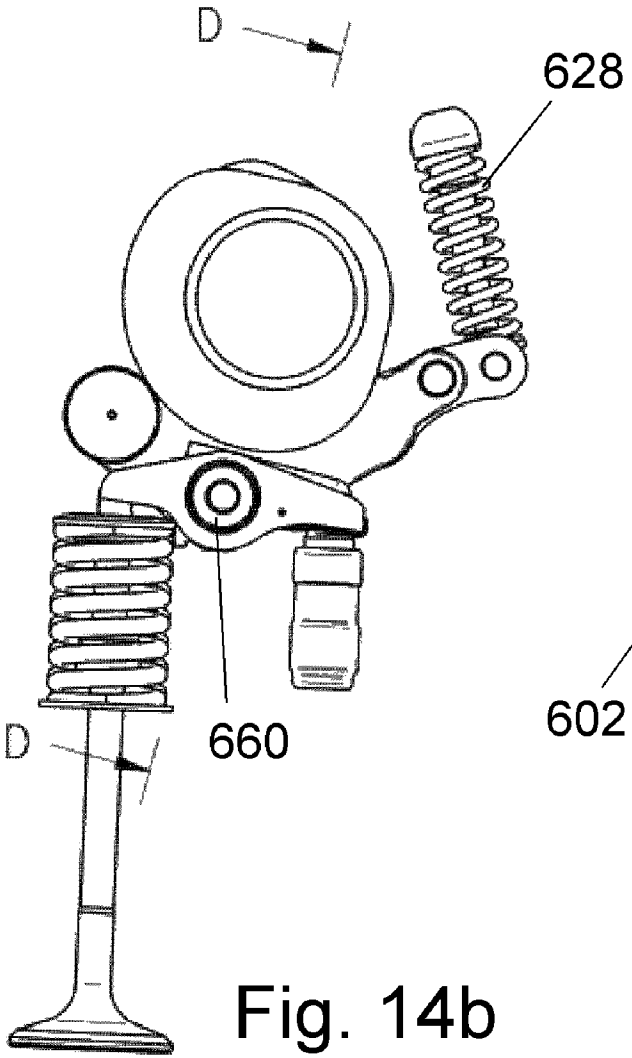
FIGS. 14*a* and 14*b* are a perspective and a side view of the embodiment of FIG. 13.
Figure 14A:
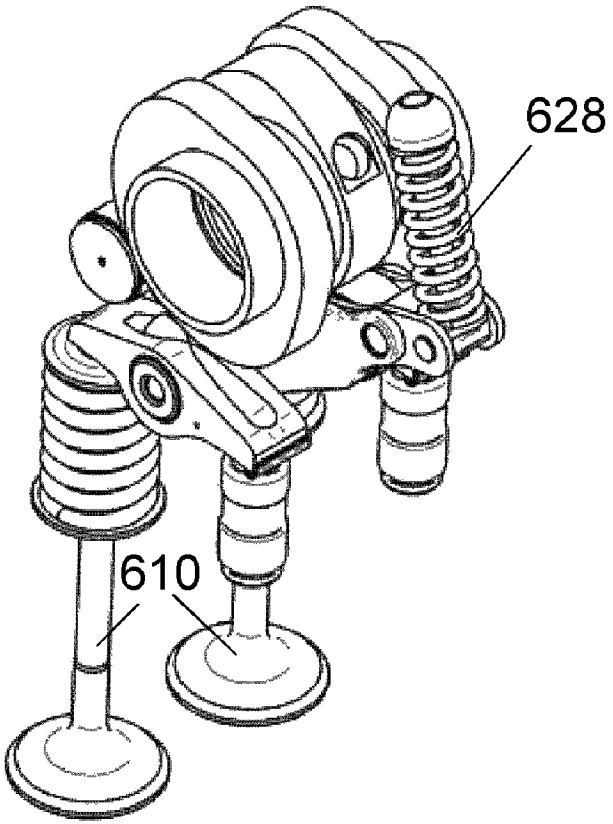

FIGS. 13 and 14 show how the latch may be designed to operate hydraulically and also depict how the concept may be applied to a pair of valves rather than a single valve.

The latching of the two summation lever parts 624*a* and 624*b* is achieved by a retractable pin 632 (see FIG. 13*c*) contained in the first part 624*a* of the summation lever that can be engaged into a receiving hole or slot in the second part 624*b* of the summation lever to lock the two parts together. The latching pin 632 has a return spring to disengage it from the second part of the summation lever, but the application of oil pressure to the pin will overcome the spring and connect the two parts of the summation lever so that valve lift is enabled. It can be appreciated that a latch could also be designed such that the return spring caused the two parts to be locked together and the application of oil pressure would deactivate the valve lift.

Oil is supplied to the latch pin 632 via the pivot shaft 660 connecting the summation lever 624*a* to the valve actuator 614, and this pivot shaft 660 also contains a spool 601 to control the timing of the latching and unlatching events, as shown in FIG. 14*c*.

Oil under pressure is fed into the pivot shaft 660 from one of the valve actuators 614 and acts to move the spool 601 and compress its return spring 602. The spool 601 may only move if there is a vent in the cavity containing the spool return spring, otherwise the position of the spool 601 is maintained via a hydraulic lock. The venting of the cavity is achieved via a drilled hole in the pivot shaft 660 and a corresponding hole in the second valve actuator 614 (see FIG. 13*a*). These two drillings only line up when the summation lever is rotated to one extreme of its motion, when the valve event has just finished. This means that the spool 601 will not move just prior to valve opening and will ensure that the latch will change state when there are no forces acting on the latch pin 632.

When the spool 601 moves to compress its return spring 602, the oil pressure is connected to the drilling through the centre of the pivot shaft (see FIG. 13*c*) and acts to engage the latch pin 632. When the oil pressure is removed, the spool 601 will move back under the action of the return spring 602 and the central drilling in the pivot shaft is connected to the vent hole at the end of the next valve event.

The preferred embodiments of the invention described above offer the following advantages:—

Valve deactivation can be achieved with only a small additional mass.

No additional lost motion spring is required, allowing the system mass and packaging space to be minimised.

The timing of the mechanical switching event can be synchronised with the motion of the actuating rocker system so that it always occurs at the correct point in the lift cycle regardless of the timing of the control input.

I claim:

1. An internal combustion engine having a valve mechanism comprising:

two cams mounted coaxially;

a summation lever having cam followers in contact with both cams, the summation lever being moveable in proportion to the instantaneous sum of the lifts of the respective cams;

a control spring to maintain contact between one cam profile and its respective follower(s); and, a valve actuating rocker having a stationary pivot and rotatably connected to the summation lever which serves to open the engine valve in dependence upon the movement of the summation lever, so as to enable the valve timing, valve lift and valve event duration to be adjusted by varying the phases of the two cams;

wherein the summation lever is constructed in two parts that can be selectively locked and unlocked to allow the valve lift to be deactivated and the motion of both parts is controlled by the control spring when the two parts of the summation lever are unlocked from one another.

2. An internal combustion engine as claimed in claim 1, wherein a pair of valves are operated by the same summation lever and both valves are being deactivated simultaneously.

3. An internal combustion engine as claimed in claim 1, further comprising a latch mechanism for selectively locking and unlocking the two parts of the summation lever the latch mechanism comprises a latch pin rotatably mounted in one of the two parts and having a recess for receiving a nose projecting from the other of the two parts, the latching mechanism being locked and unlocked by rotation of the latch pin.

4. An internal combustion engine as claimed in claim 1, further comprising a latch mechanism for selectively locking and unlocking the two parts of the summation lever, the latch mechanism comprises one or more slidable pins that are selectively engaged in one either one part or in both parts of the summation lever.

5. An internal combustion engine as claimed in claim 4, wherein a sliding pin is mounted within a hollow axle of one of the cam followers.

6. An internal combustion engine as claimed in claim 1 further comprising a latch mechanism for selectively locking and unlocking the two parts of the summation lever the latch mechanism being mechanically movable between its locked and unlocked positions.

7. An internal combustion engine as claimed in claim 6, wherein the latch mechanism is operated by a deactivation lever rotatable about a common axis to that of the valve actuating rocker.

8. An internal combustion engine as claimed in claim 6 wherein the latch mechanism is controlled by rotation of the pivot shaft connecting the valve actuating rocker and the summation lever.

9. An internal combustion engine as claimed in claim 6, wherein the timing of the latch changing state is dictated by the summation lever motion.

10. An internal combustion engine as claimed in claim 9, wherein the motion of the summation lever is used directly to move the latching element.

11. An internal combustion engine as claimed in claim 9, further comprising a latch mechanism and an interlock mechanism, wherein the interlock mechanism is used to coordinate the latching mechanism with the motion of the summation lever.

12. An internal combustion engine as claimed in claim 1, further comprising a state changing latch mechanism which is operated hydraulically.

13. An internal combustion engine as claimed in claim 12, wherein the timing of the latch changing state is dictated by the summation lever motion, and wherein a spool is used to control the latch timing independently to that of the oil pressure supply.

14. An internal combustion engine as claimed in claim 12, wherein the timing of the latch changing state is dictated by the summation lever-motion, and a hydraulic lock is used to coordinate the latching mechanism with the movement of the summation lever.

15. An internal combustion engine as claimed in claim 1, wherein the clearance in the rocker system is adjustable by changing the relative positions of the two parts of the summation lever when the latch is engaged in the valve actuating state.

* * * * *